US008601619B2

(12) United States Patent
McNulty

(10) Patent No.: US 8,601,619 B2
(45) Date of Patent: Dec. 10, 2013

(54) BODY TRANSFER SYSTEM WITH YAW CONTROL

(75) Inventor: Christopher McNulty, Concord, MA (US)

(73) Assignee: Astir Technologies, LLC, Concord, MA (US)

( * ) Notice: Subject to any disclaimer, the term of this patent is extended or adjusted under 35 U.S.C. 154(b) by 274 days.

(21) Appl. No.: 12/749,019

(22) Filed: Mar. 29, 2010

(65) Prior Publication Data

US 2010/0242169 A1 Sep. 30, 2010

Related U.S. Application Data

(60) Provisional application No. 61/164,033, filed on Mar. 27, 2009.

(51) Int. Cl.
*A61G 1/003* (2006.01)

(52) U.S. Cl.
USPC ..... 5/81.1 C; 5/81.1 HS; 5/81.1 R

(58) Field of Classification Search
USPC ..... 5/81.1 R, 81.1 C, 81.1 HS; 414/921; 198/301, 312, 315, 321–323
See application file for complete search history.

(56) References Cited

U.S. PATENT DOCUMENTS

| | | | |
|---|---|---|---|
| 3,419,920 | A | 1/1969 | Maddux, Jr. et al. |
| 3,593,351 | A | 7/1971 | Dove |
| RE28,056 | E | 6/1974 | Stevens |
| 3,871,036 | A | 3/1975 | Attenburrow |
| 3,947,902 | A | 4/1976 | Conde et al. |
| 3,967,328 | A | 7/1976 | Cox |
| 4,019,772 | A | 4/1977 | Lee |
| 4,073,016 | A | 2/1978 | Koll |
| 4,077,073 | A | 3/1978 | Koll et al. |
| 4,087,873 | A | 5/1978 | Ohkawa |
| 4,156,946 | A | 6/1979 | Attenburrow |
| 4,195,375 | A | 4/1980 | Paul |
| 4,272,856 | A | 6/1981 | Wegener et al. |
| 4,297,753 | A | 11/1981 | Langren |
| 4,507,814 | A | 4/1985 | Zyki, Jr. |
| 4,517,690 | A | 5/1985 | Wegener |
| 4,528,704 | A | 7/1985 | Wegener et al. |
| 4,686,719 | A | 8/1987 | Johnson et al. |
| 4,723,327 | A | 2/1988 | Smith |
| 4,737,997 | A | 4/1988 | Lamson |
| 4,744,115 | A | 5/1988 | Marchione |
| 4,747,170 | A | 5/1988 | Knouse |
| 4,761,841 | A | 8/1988 | Larsen |

(Continued)

FOREIGN PATENT DOCUMENTS

DE 10023729 C1 3/2010

OTHER PUBLICATIONS

MLA AT-2000 Patient Transfer System, http://www.ssl.gb.com/knight/mla_stretchairs.htm; Jul. 1, 2003; pp. 4-5.

*Primary Examiner* — Nicholas Polito
(74) *Attorney, Agent, or Firm* — Onello & Mello, LLP

(57) ABSTRACT

A system for transferring a body from a first surface to a second surface, or supporting a body during such translation with substantially no agitation of the body, is provided. The system can include yaw feedback control to promote and/or insure straightness of travel. The system could additionally or alternatively include a patient rotation sensing and adjustment system. The body can be supported by a pad, but it is not essential in all embodiments.

11 Claims, 12 Drawing Sheets

(56) References Cited

U.S. PATENT DOCUMENTS

| | | | | | |
|---|---|---|---|---|---|
| 4,794,655 | A | | 1/1989 | Ooka et al. | |
| 4,868,938 | A | | 9/1989 | Knouse | |
| D306,148 | S | | 2/1990 | Dannals et al. | |
| 4,970,738 | A | | 11/1990 | Cole | |
| 4,977,630 | A | | 12/1990 | Oswalt et al. | |
| 4,985,952 | A | | 1/1991 | Edelson | |
| 4,987,623 | A | | 1/1991 | Stryker et al. | |
| 5,051,293 | A | | 9/1991 | Breitsceidel et al. | |
| 5,059,090 | A | * | 10/1991 | Bobroff et al. | 414/749.3 |
| D329,216 | S | | 9/1992 | Beeley et al. | |
| D339,771 | S | | 9/1993 | Newman | |
| 5,257,425 | A | | 11/1993 | Shinabarger | |
| 5,271,110 | A | | 12/1993 | Newman | |
| 5,490,073 | A | * | 2/1996 | Kyrtsos | 701/470 |
| 5,522,100 | A | | 6/1996 | Schilling et al. | |
| 5,561,873 | A | | 10/1996 | Weedling | |
| 5,570,483 | A | | 11/1996 | Williamson | |
| RE35,468 | E | | 3/1997 | Newman | |
| 5,737,781 | A | | 4/1998 | Votel | |
| 5,771,513 | A | | 6/1998 | Kirchgeorg et al. | |
| D402,434 | S | | 12/1998 | Votel | |
| 5,860,174 | A | | 1/1999 | Failor | |
| 5,890,238 | A | | 4/1999 | Votel | |
| 5,920,929 | A | | 7/1999 | Hensley et al. | |
| 6,012,183 | A | | 1/2000 | Brooke et al. | |
| 6,233,766 | B1 | | 5/2001 | Ohman | |
| 6,349,432 | B1 | | 2/2002 | Scordato et al. | |
| 6,698,041 | B2 | | 3/2004 | VanSteenburg et al. | |
| 6,711,766 | B2 | | 3/2004 | Monk et al. | |
| 6,857,143 | B2 | * | 2/2005 | McNulty | 5/81.1 C |
| 7,603,729 | B2 | * | 10/2009 | Patterson | 5/81.1 HS |
| 2001/0047543 | A1 | | 12/2001 | VanSteenburg et al. | |
| 2003/0182723 | A1 | | 10/2003 | Kasagami et al. | |
| 2007/0056096 | A1 | | 3/2007 | Assink | |

* cited by examiner

BODY TRANSFER SYSTEM WITH YAW CONTROL

CROSS REFERENCES TO RELATED APPLICATIONS

This application claims the benefit of priority under 35 U.S.C. §119(e) from co-pending, commonly owned U.S. provisional patent application Ser. No. 61/164,033, entitled BODY TRANSFER SYSTEM WITH YAW CONTROL, filed Mar. 27, 2009, which is hereby incorporated by reference in its entirety.

This application may also be related to U.S. Patent Publication 2009-0094742 entitled BODY TRANSFER SYSTEM AND METHOD; U.S. Pat. No. 7,552,493 entitled BODY TRANSFER SYSTEM AND SUPPORT PADS, issued Jun. 30, 2009; and U.S. Pat. No. 6,857,143, entitled BODY TRANSFER SYSTEM, issued Feb. 22, 2005, each of which is hereby incorporated by reference in its entirety.

FIELD OF THE INVENTION

The inventive concepts relate to systems and methods for supporting or transferring a body. More specifically, the present invention relates to systems and methods for transferring a body without the need for lifting or pulling by individuals or complicated lifting or pulley mechanisms or for supporting a body generally during such transfer.

BACKGROUND

The transfer of patients between hospital beds and stretchers is a significant cause of musculoskeletal disorders (MSDs) in caregivers within the healthcare sector. Although there is considerable prior art disclosing mechanical means to aid in accomplishing the task, most caregivers still resort to physically lifting the patient between the hospital bed and stretcher or gurney. Gangly, ineffective and time-consuming devices have thus far been used with less frequency to the favor of a simple backboard with hand holds around the perimeter (U.S. Design Pat. No. 329,216). During a patient transfer, the stretcher is placed adjacent to the hospital bed. The patient is rolled on his/her side and the backboard is slid under the patient. The patient is rolled back on the board. The caregivers must reach over the bed and lift and pull in an outstretched manner that places excessive stress to the back and shoulders. Over time, the caregiver may encounter sudden or progressive MSD injuries.

Transferring patients is not only injury prone, it is also labor intensive. Recent OSHA guidelines for reducing MSD injuries in nursing homes recommends two or more caregivers to accomplish a bed-to-bed transfer. As many as six caregivers may be required for larger non-ambulatory patients. Bariatric patients, severely obese, are moved in their hospital beds and not transferred to a stretcher, as the risk of injury to move them is typically considered too high.

In addition to the injury of the caregiver, injury can occur to the patient during a transfer. An IV pull, a shear injury to a bed sore, bruised or broken bones can result in older and fragile patients.

Additionally, the transfer of patients from a seated position on one surface to a lying position on another surface, or vice versa, is even more complicated. Systems and methods that attempt to address such situations are even more rare. Generally, care givers are left to team up and be as careful as possible in physically lifting and transferring the patient.

As will be appreciated, beyond the transferring of patients, similar issues of moving bodies of significant weight exist. For example, movement of cadavers could pose a similar risk of injury to those attempting to transfer the body. Such bodies could also, in other applications, include animals or large objects.

SUMMARY OF THE INVENTION

In accordance with aspects of the present invention, provided is a system for transferring a body from a first surface to a second surface. The system includes: a frame configured to support a body; a bottom translation mechanism disposed at the bottom portion of the frame and configured to engage the first surface and the second surface and to translate the system back and forth between the second surface and the first surface; a top translation mechanism disposed at the top portion of the frame and configured to burrow the system between the first surface and the body as the bottom translation mechanism transfers the system from the second surface to the first surface; and a yaw control system operatively coupled to the bottom translation mechanism and configured to sense and adjust for non-straight motion of the frame as it moves between the first and second surfaces.

The frame can be a housing having a substantially planar top portion configured to support a body and having a substantially planar bottom portion.

The yaw control system can include at least one sensor and a feedback loop shared between the at least one sensor and the bottom translation mechanism.

The at least one sensor can include at least one accelerometer.

The at least one sensor can include at least one gyroscope sensor.

The bottom translation mechanism can include at least two independently controlled translation mechanisms that are each operatively coupled to the yaw control system.

The at least two independently controlled translation mechanisms of the bottom translation mechanism can include at least two sets of independently controlled belts.

Each of the at least two independently controlled translation mechanisms that are each operatively coupled to the yaw control system can include at least one motor having an output adjusted in response to the yaw control system.

In accordance with another aspect of the present invention, provided is a method of transferring a body from a first surface to a second surface. The method includes: providing a frame configured to support a body; using a bottom translation mechanism disposed at the bottom portion of the frame, translating the system back and forth between the second surface and the first surface; using a top translation mechanism disposed at the top portion of the frame, burrowing between the first surface and the body as the bottom translation mechanism transfers the frame from the second surface to the first surface; and sensing and adjusting for non-straight motion of the frame as it moves between the first and second surfaces using a yaw control system operatively coupled to the bottom translation mechanism.

The frame can be a housing having a substantially planar top portion configured to support a body and having a substantially planar bottom portion.

The yaw control system can include at least one sensor and a feedback loop shared between the at least one sensor and the bottom translation mechanism.

The at least one sensor can include at least one accelerometer.

The at least one sensor can include at least one gyroscope sensor.

The bottom translation mechanism can include at least two independently controlled translation mechanisms, and the method can include controlling each of the at least two independently controlled translation mechanisms with the yaw control system.

The at least two independently controlled translation mechanisms of the bottom translation mechanism can include at least two sets of independently controlled belts.

Each of the at least two independently controlled translation mechanisms that are each operatively coupled to the yaw control system can include at least one motor having an output adjusted in response to the yaw control system.

In accordance with another aspect of the invention, provided is a system for transferring a body from a first surface to a second surface. The system includes: a frame configured to support a body; a bottom translation mechanism disposed at the bottom portion of the frame and configured to engage the first surface and the second surface and to translate the system back and forth between the second surface and the first surface; a top translation mechanism disposed at the top portion of the frame and configured to burrow the system between the first surface and the body as the bottom translation mechanism transfers the system from the second surface to the first surface; and a motion control system. The motion control system is operatively coupled to the bottom translation mechanism and configured to sense and adjust for non-straight motion of the frame as it moves between the first and second surfaces, and is operatively coupled to the top translation mechanism and configured to sense and adjust for non-straight alignment of a body loaded or loading onto the frame.

The motion control system can include a yaw control system operatively configured to control the bottom translation mechanism.

The motion control system can include a patient orientation system operatively configured to control the top translation mechanism.

The bottom translation mechanism can include at least two independently controlled translation mechanisms that are each operatively coupled to the yaw control system. And the top translation mechanism can include at least two independently controlled translation mechanisms that are each operatively coupled to the patient orientation system.

In accordance with another aspect of the invention, provided is a system for transferring a body from a first surface to a second surface. The system includes: a frame configured to support a body; a bottom translation mechanism disposed at the bottom portion of the frame and configured to engage the first surface and the second surface and to translate the system back and forth between the second surface and the first surface; a top translation mechanism disposed at the top portion of the frame and configured to burrow the system between the first surface and the body as the bottom translation mechanism transfers the system from the second surface to the first surface; and a patient orientation system operatively coupled to the top translation mechanism and configured to sense and adjust for non-straight alignment of a body loaded or loading onto the frame.

The frame can be a housing having a substantially planar top portion configured to support a body and having a substantially planar bottom portion.

The patient orientation system can includes at least one sensor and a feedback loop shared between the at least one sensor and the top translation mechanism.

The at least one sensor can include at least one magnet.

The at least one sensor can include at least one bar code position sensors.

The top translation mechanism can include at least two independently controlled translation mechanisms that are each operatively coupled to the patient orientation system.

The at least two independently controlled translation mechanisms of the top translation mechanism can include at least two sets of independently controlled belts.

Each of the at least two independently controlled translation mechanisms that are each operatively coupled to the patient orientation system can include at least one motor having an output adjusted in response to the patient orientation system.

In accordance with another aspect of the invention, provided is a method of transferring a body from a first surface to a second surface. The method includes: providing a frame configured to support a body; using a bottom translation mechanism disposed at the bottom portion of the frame, translating the system back and forth between the second surface and the first surface; using a top translation mechanism disposed at the top portion of the frame, burrowing between the first surface and the body as the bottom translation mechanism transfers the frame from the second surface to the first surface; and sensing and adjusting for non-straight alignment of a body loaded or loading onto the frame using a patient orientation system operatively coupled to the top translation mechanism.

The frame can be a housing having a substantially planar top portion configured to support a body and having a substantially planar bottom portion.

The patient orientation system can include at least one sensor and a feedback loop shared between the at least one sensor and the top translation mechanism.

The at least one sensor can include at least one magnet.

The at least one sensor can include at least one bar code position sensor.

The top translation mechanism can include at least two independently controlled translation mechanisms, and the method can include controlling each of the at least two independently controlled translation mechanisms with the patient orientation system.

The at least two independently controlled translation mechanisms of the top translation mechanism can include at least two sets of independently controlled belts.

Each of the at least two independently controlled translation mechanisms that are each operatively coupled to the patient orientation system can include at least one motor having an output adjusted in response to the patient orientation system.

In any of the above systems and methods, the frame can be divided into an upper portion and a lower portion, and can further include a hinge mechanism, which may or may not include a lock mechanism configured to secure the upper portion at and angle with respect to the lower portion.

In any of the above systems and methods, a translation monitor may be provided that is operatively coupled to the bottom translation mechanism and configured to stop translation of the system in response to a detection of an end of the first surface or the second surface. Alternatively, or additionally, the system may include means to measure the translation distance from the second surface to the first surface and to measure the translation distance from the first surface back to the second surface. In such a case, the translation monitor may be configured to cease translation when the second translation distance is about equal to or greater than the first translation distance.

Also, in any of the foregoing systems and methods, one or more guard members may be included as a physical barrier to loose items vulnerable to being drawn into the various translation mechanisms.

A pad can be used in some implementations, but it is not required in all implentations.

BRIEF DESCRIPTION OF THE DRAWINGS

The drawing figures depict preferred embodiments by way of example, not by way of limitations. In the figures, like reference numerals refer to the same or similar elements.

DETAILED DESCRIPTION

In accordance with the present invention, a body transfer system and method enable transfer of a body from a first surface to a second surface, without the need for heavy lifting or pulling by individuals or the need for cumbersome pulley or lift systems. The first and second surface may each be substantially flat surfaces, or one or both of the first and second surfaces could be comprised of a plurality of substantially flat surfaces or curved surfaces. To accommodate such surfaces the body transfer system could include one or more pivot, bend or flex points.

Figure 1A:
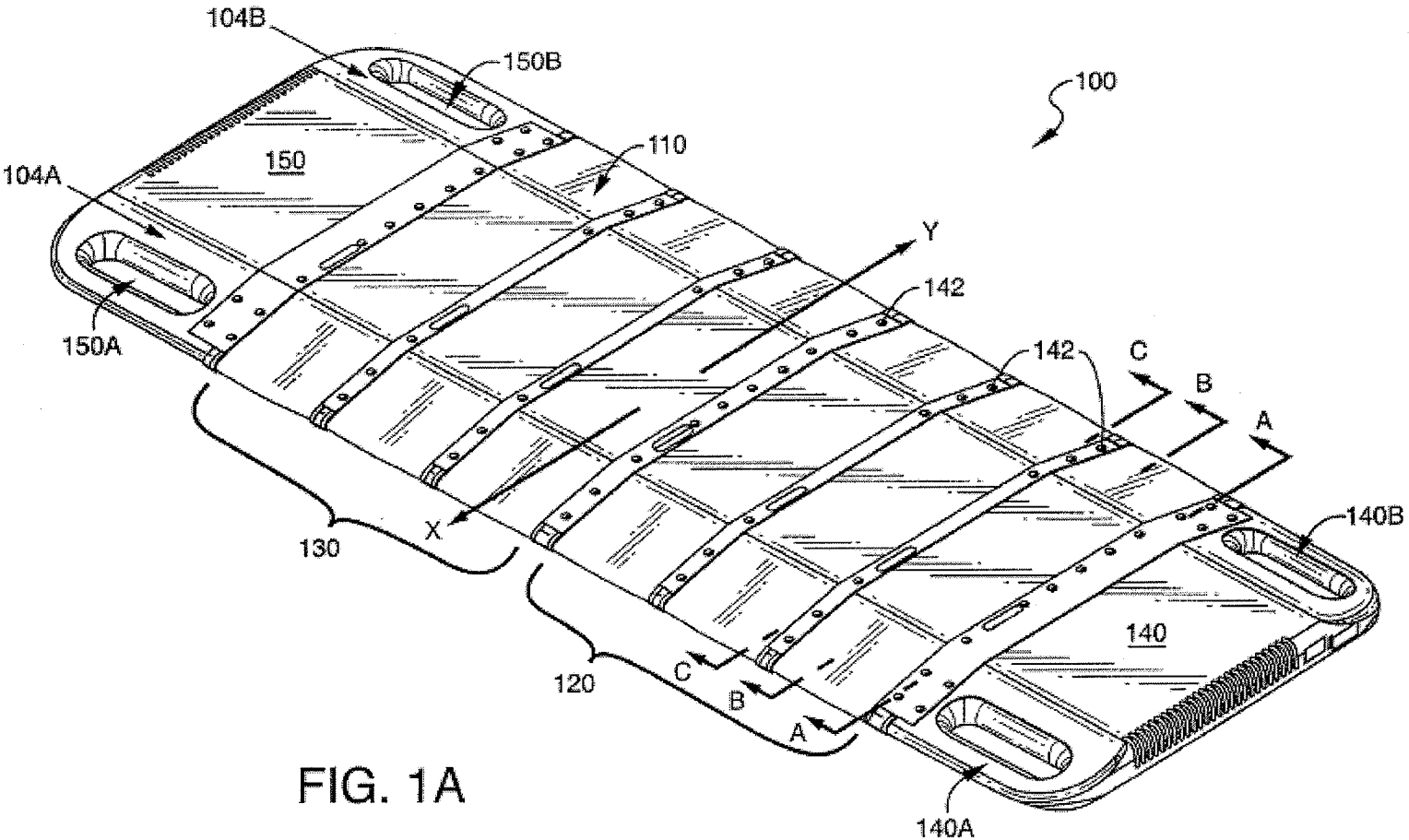
FIG. 1A is a perspective top view of a body transfer system in accordance with the present invention.
Figure 1B:
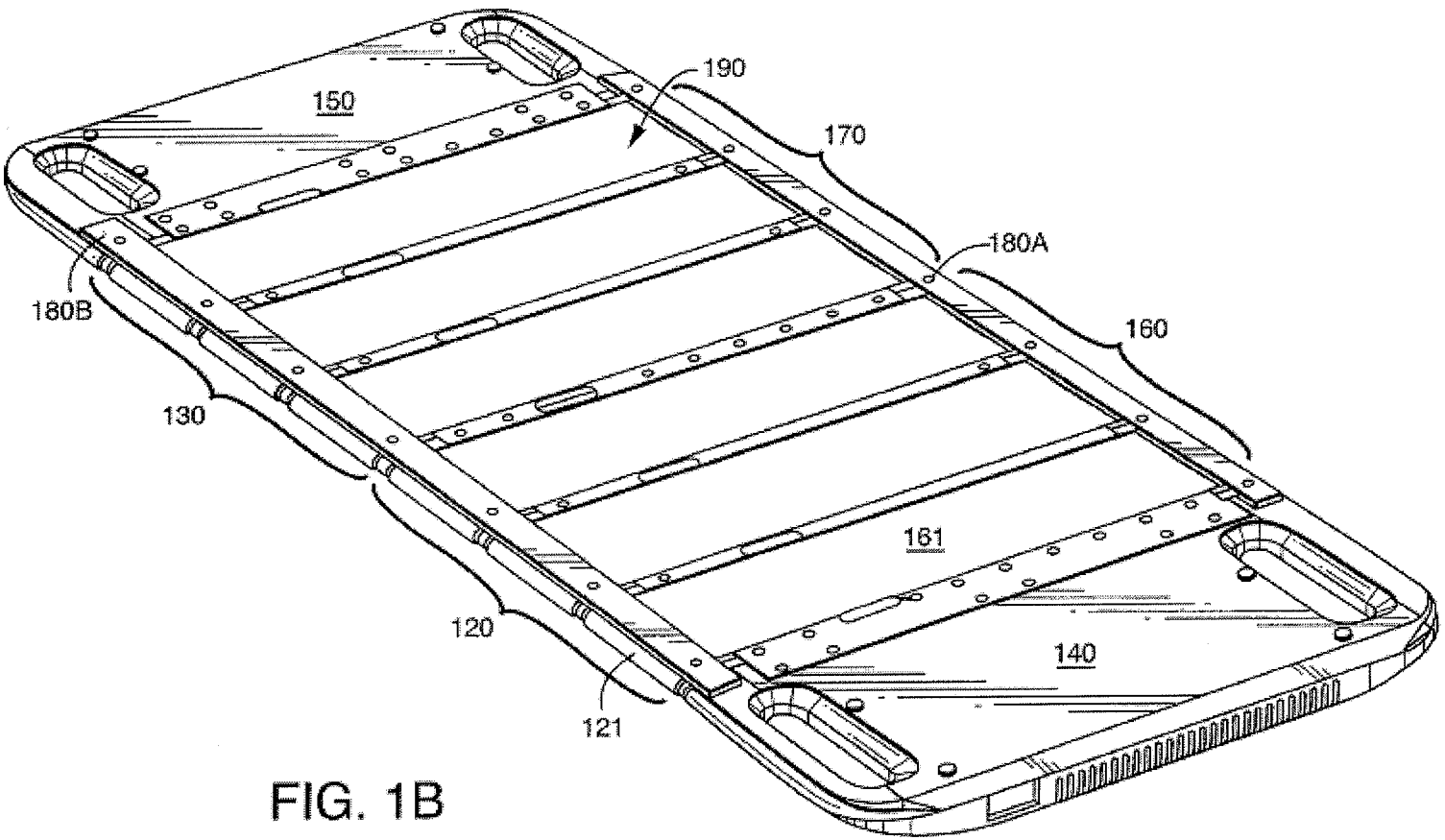
FIG. 1B is a perspective bottom view of the body transfer system of FIG. 1A.

FIG. 1A and FIG. 1B show an embodiment of a body transfer system 100 in accordance with the present invention. By way of example, and not by limitation, the body transfer system 100 is sized and shaped to accommodate transfer of a human body, so is shown as being about 5.5 feet to about 6.5 feet or so in length and about 1.5 to 2.5 feet in width. The exact dimensions can be varied, even beyond the exemplary ranges provided here, depending on the size of the bodies intended to be transferred. For example, for unusually tall or wide bodies the length or width or both could be greater. And, as another example, if the size of the bodies intended to be moved are smaller, then the dimensions could be smaller than the ranges provided here. Of course, if the body transfer system is intended for transfer of non-human bodies, e.g., animals, heavy apparatus, and so on, the dimensions would be chosen accordingly.

As can be seen from the perspective view of FIG. 1A, at its top surface 110 the body transfer system 100 includes a lengthwise central portion 102 that is substantially flat and also includes two beveled lengthwise outer portions 104A, 104B. In the illustrative embodiment, the body transfer system is configured to move in a direction generally normal (or orthogonal) to its length. That is, the body transfer system's motion is generally planar and in the directions of arrows X and Y. Additionally, as will be described in greater detail below, the body transfer system 100 may also be configured to rotate in the same plane. The outer beveled edges 104A, 104B allow the body transfer system 100 to burrow beneath the body when the body transfer system moves in generally in the direction of arrows X or Y. Although, in other embodiments, if the profile of the body transfer system is sufficiently thin, the beveled edges may be omitted.

The body transfer system 100 includes a housing that is comprised of a first end 140 and a second end 150, with a main housing portion 142 disposed therebetween. Preferably, the first end 140 includes a pair of handles 140A, 140B to enable easy carrying of the body transfer system. Similarly, the second end 150 also includes a pair of handles 150A, 150B. At least one translation means is disposed at the top surface 110. The translation means at the top surface 110 facilitates movement of the body transfer system 110 relative to the body to be transferred. In the illustrative form, the translation means takes the form of a series of belts. The series of belts is exposed at the top surface 110 such that they can engage a body or a mat or mattress upon which the body is located. In some embodiments these belts can be padded to, for example, enhance patient comfort—and possibly eliminate the use of a pad. Relative to the body to be transferred, the series of belts causes the body transfer system 100 to move in a forward direction, such as the direction of arrow X, and in an opposite, or reverse direction, such as the direction of arrow Y.

In this embodiment, the series of belts includes a first set of belts 120 and a second set of belts 130. In other embodiments, rather than a series of belts, a single belt could be used. In yet other embodiments, rather than belts, the translation means could be comprised of a series of rollers, wheels or vibratory plates. In the embodiment of FIG. 1A, each set of belts 120 and 130 includes 3 belts. As will be appreciated by those skilled in the art, a different number of belts would suffice and it is not imperative that the number of belts in the first set of belts 120 is the same as the number of belts in the second set of belts 130. For example, the first set of belts 120 could be a single belt that could, for example, cover a length of the housing 142 that is about equivalent to the combined length of the 3 belts that comprise the first set of belts 120. In other embodiments, a mix of belts and rollers could be used, a mix of belts and wheels could be used, a mix of wheels and rollers could be used or a mix of belts, wheels and rollers could be used. As will be appreciated by those skilled in the art, there are a variety of combinations of belts, wheels, rollers, vibratory plates or other translation means that could be used alone or in combination, without departing from the present invention.

The translation means includes at least one motor that drives the series of belts. That is, the first set of belts 120 and second set of belts 130 could be driven by a single motor. In such a case, rotation of the body transfer system 100 would not be possible using the single motor. In the preferred form, the first set of belts 120 is driven by a first motor and the second set of belts 130 is driven by a second motor. If belts in addition to the first set of belts 120 and second set of belts 130 were included at the top portion 110, then an additional one or more motors could be added, as an example. In an embodiment where there is only a single motor for the top surface translation means, the series of belts could be a single belt that, for example, could cover a length of the housing 142 that is about equivalent to the span covered by the first and second sets of belts 120, 130, i.e., the 6 belts shown.

In the embodiment of FIG. 1A, driving the first set of belts 120 and the second set of belts 130 with different motors allows rotation of the body transfer system 100 with respect to the body or mat or mattress upon which the body is located. Rotation is effected by driving each set of belts at different rates or in different directions, or both. Of course, if the translation mechanism included rollers, wheels, vibratory plates or other translation means the number and configuration of motors would be chosen to effect a similar translation result.

As an example, the belts may be seamless semi-elastic polyurethane belts. In this embodiment, where a human body is to be transferred, the tensile strength of the belts is chosen to be about 500 lbs/inch width with a coefficient of friction of about 0.1 for the inner portion of the belt and about 0.3 for the exposed outer portion of the belt. Although, other types of belts having similar properties may be used, e.g., belts including some amount of rubber or fabric. And, the tensile strength and coefficients of friction may be altered based on any of a variety of factors, for example, the expected coefficient of friction of a mat or mattress that the body transfer system may be intended to burrow under, the range of weights of the bodies intended to be transferred, the geometry of the belts and so on. The belts could be smooth or include protrusions, so long as they are sufficiently contoured to grip and burrow under the body, mat or mattress, as the case may be.

FIG. 1B shows a bottom surface 190 of the body transfer system 100. In this embodiment, the bottom surface 190 includes a second translation means configured to move the body transfer system 110 relative to the first and second surfaces, e.g., table surface or bed surface, upon which rests the body transfer system 110 and the body to be moved. The second translation means, in the embodiment of FIG. 1B, includes a second series of belts that span a portion of the length of the body transfer system 100, i.e., similar to the length spanned by the series of belts at the top surface 110. As with the series of belts at the top surface 110, the second series of belts at the bottom surface 190 includes two sets of belts, i.e., a third set of belts 160 and a fourth set of belts 170, in the illustrative embodiment. As is the case with the translation means at the top surface 110, the translation means of the bottom surface 190 could be comprised of different arrangements of belts, rollers, wheels, vibratory plates or the like in other embodiments.

The third set of belts 160 and fourth set of belts 170 may be comprised of materials having similar properties to those of the first set of belts 120 and second set of belts 130. That is, the third set of belts 160 and fourth set of belts 170 could be seamless semi-elastic polyurethane belts having a tensile strength of about 500 lbs/inch width with a coefficient of friction of about 0.1 for the inner portion of the belt and about 0.3 for the exposed outer portion of the belt. Like the first set of belts 120 and the second set of belts 130, the third set of belts 160 and the fourth set of belts 170 are driven by a third motor and a fourth motor, but different motor arrangements could be used in other embodiments. Having a separate motor drive each of the third and fourth sets of belts allows rotation of the body transfer system 100 with respect to the surface upon which the body transfer system is located, as discussed above with respect to the first set of belts 120 and second set of belts 130.

If separate control of the third set of belts 160 and forth set of belts 170 is not desired, then a single motor could be used to drive both sets of belts. Therefore, in a simplified embodiment, one motor could drive the belts at the top surface and a different motor could drive the belts at the bottom surface.

In yet another embodiment, a single motor could drive the belts at the top surface 110 and the belts at the bottom surface 190. In such an embodiment, the motor engages each of the top surface belts and bottom surface belts when burrowing underneath, or from underneath, the body, mat, or mattress. In such a case, the top surface belts would move in a first direction (e.g., counter clockwise) and the bottom surface belts would move in an opposite direction (e.g., clockwise) to effect burrowing underneath, or from underneath, the body, mat, or mattress. This can be accomplished with any of a number of typical gear arrangements. When transferring the body from the first surface to the second surface, only the bottom surface belts would be engaged by the motor.

The body transfer system 100 may also include sheet guards 180A and 180B disposed along the length of the outer edges of the bottom surface 190 that prevent sheets or other materials from getting pulled into the various sets of belts used for transfer and translation. As can be seen from both FIG. 1A and FIG. 1B, the first set of belts 120 and second set of belts 130 extend to the outermost edges of the body transfer system 100, such that they can easily engage and burrow beneath, or from underneath, the body or mat or mattress upon which the body rests.

Figure 2:
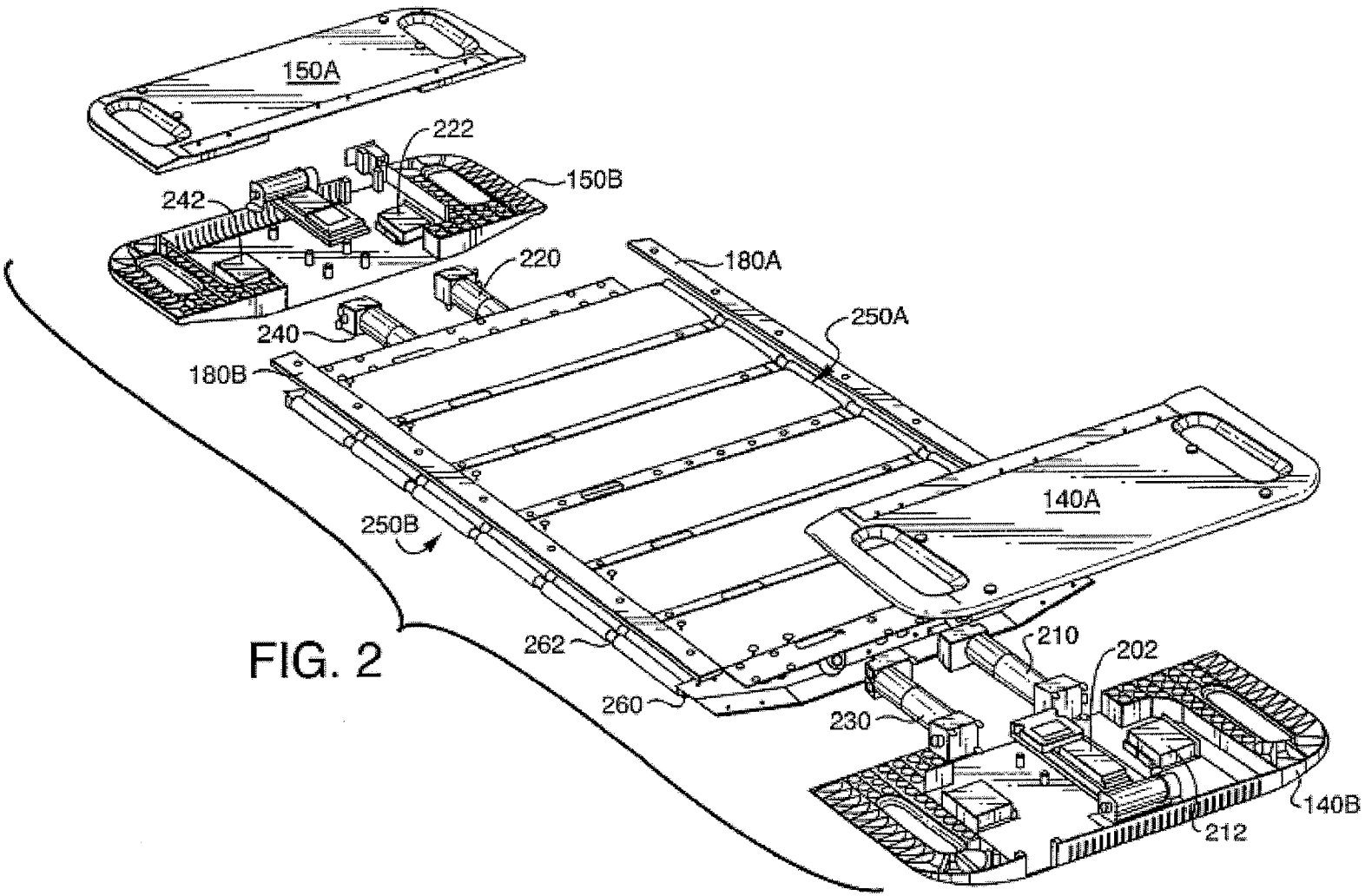
FIG. 2 is an exploded view of the body transfer system of FIG. 1A and FIG. 1B.

FIG. 2 shows an exploded view of the body transfer system of FIG. 1B. In this embodiment, the first end 140 of the body transfer system 100 is comprised of a first piece 140A and a second piece 140B that couple to a first end rib 260. The first piece 140A and second piece 140B may be formed from molded plastic or some other relatively rigid material. Within first end 140 are disposed two belt drive mechanisms, one to drive the first set of belts 120 at the top surface 110 and one to drive the third set of belts 160 at the bottom surface 190. Each drive mechanism takes the form of a motor assembly. For example, a first motor assembly configured to drive the first set of belts 120 is comprised of motor 210 and motor controller 212. A third motor assembly configured to drive the third set of belts 160 is comprised of motor 230 and motor controller 232. Also disposed within first end 140 is a power supply 202 that, in this embodiment, services each of the first and third motor assemblies.

The second end 150 also includes a first piece 150A and second piece 150B that couple to a second end rib (not shown), formed in a manner similar to pieces 140A and 140B of the first end 140. Also, within second end 150 are disposed two belt drive mechanisms, one to drive the second set of belts 130 at the top surface 110 and one to drive the fourth set of belts 170 at the bottom surface 190. Each drive mechanism takes the form of a motor assembly. For example, a second motor assembly configured to drive the second set of belts 130 is comprised of motor 220 and motor controller 222. A fourth motor assembly configured to drive the fourth set of belts 170 is comprised of motor 240 and motor controller 242. Also disposed within second end 150 may be a second power supply 204 that, in this embodiment, services each of the second and fourth motor assemblies. In another embodiment, all drive mechanisms may be supplied power from a single power supply. The power supplies 202, 204 receive their power from a standard 120 VAC (volts AC) source (not shown), but could also receive power from DC supplies, e.g., batteries, in other embodiments.

A master controller may be included to provide instructions to each of the motor controllers 212, 222, 232, 242. Or, one of the motor controllers 212, 222, 232, or 242 could serve as the master controller. A control panel, remote control (see FIG. 5), personal computer, or other such device may provide movement, translation and transfer instructions to each motor controller via wired or wireless means.

FIG. 2 also includes two sets of rollers 250A and 250B that run along the outer edges of the housing 142 of the body transfer system 100. As will be appreciated with respect to FIG. 3B, these rollers facilitate movement of the sets of belts. Additionally, housing 142 includes intermediate support that provides rigidity and strength to the body transfer system 100. In this embodiment, the intermediate support takes the form of a set of cross members or ribs that span the width of the body transfer system 100, e.g., rib 262. The ribs in this embodiment are disposed within the housing 142 and between the belts. The ribs may be made from a relatively rigid material, such as an aluminum alloy. In other embodiments, different types of intermediate support could be used or fewer ribs could be used. The different rollers from the sets of rollers 250A, 250B are disposed between the ribs.

Figure 3A:
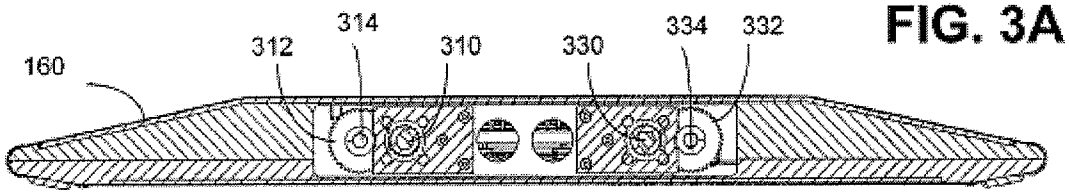
FIG. 3A through FIG. 3C are cross sectional view of the of the body transfer system of FIG. 1A and FIG. 1B.
Figure 3B:
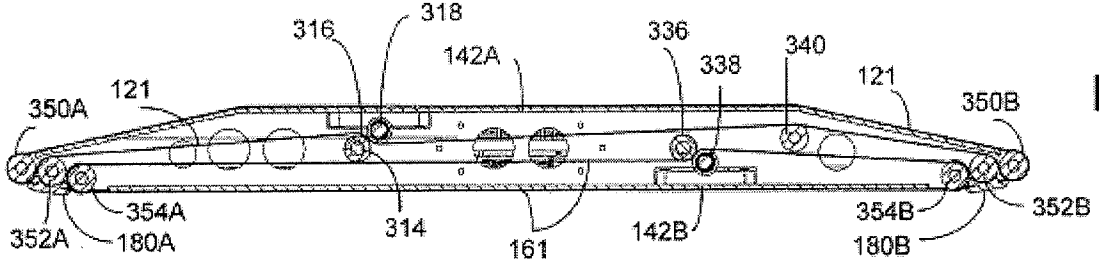
Figure 3C:
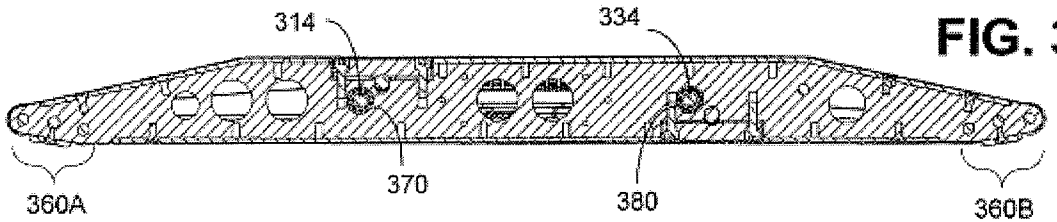

FIGS. 3A, 3B, and 3C show cross sections of the body transfer system 110 at different points. FIG. 3A shows cross section A-A taken at line A-A of FIG. 1A. Section A-A is taken looking into rib 260 of the first end 140, i.e., where the first end couples to housing 142 of FIG. 1A. Rib 260 includes an interface to each of motors 210 and 230. The first interface for motor 210 includes a first rotatable coupling 310 that engages a first gear 312. The first gear 312 is coupled at its center to a first rod 314. The first rod 314 is rotated in response to actuation of first gear 312 via first coupling 310 by motor 210. As will be appreciated with respect to FIG. 3B, rotation of first rod 314 cause rotation of the first set of belts 120 at the top surface 110.

A third motor interface is similar to that of the first motor interface, but is used to drive the third set of belts 160 at the bottom surface 190. Accordingly, the third motor interface includes a third rotatable coupling 330 that engages a third gear 332. The third gear 332 is coupled at its center to a third rod 334. The third rod 334 is rotated in response to actuation of third gear 332 via first coupling 330 by motor 230. As will be appreciated with respect to FIG. 3B, rotation of third rod 334 causes rotation of the third set of belts 160 at the bottom surface 190.

FIG. 3B shows a cross section B-B taken at line B-B of FIG. 1A. Cross section B-B is taken within housing 142 and between first end rib 260 and intermediate rib 262. Also shown are a top surface panel 142A and a bottom surface panel 142B. In this embodiment, panels 142A and 142B are chosen to add structural support and to define a contour over which the various belts travel. As an example, panels 142A and 142B may be made from a relatively rigid material, such as an aluminum alloy. The panels 142A and 142B couple to the series of ribs and first end 140 and second end 150 to form the housing 142.

First rod 314 extends from first end rib 260 through housing 142 and terminates at a rib disposed between the first set of belts 120 and second set of belts 130, which is also disposed between the third set of belts 160 and fourth set of belts 170. Between first end rib 260 and rib 262 a drive roller 316 is secured to first rod 314, such that rotation of the first rod causes rotation of drive roller 316. A free spinning roller 318 opposes drive roller 316 with a first belt 121, of the first set of belts 120, disposed between rollers 316 and 318. The force exerted by drive roller 316 on belt 121 is opposed by free spinning roller 318, causing sufficient traction by drive roller 316 to move first belt 121. Additionally, guide rollers 340, 350A and 350B and 352A and 352B serve to guide first belt 121, with guide rollers 350A and 352A guiding belt 121 at one outer edge and guide rollers 350B and 352B guiding belt 121 at the other outer edge. This arrangement of rollers and rods is accomplished for each belt in the first set of belts 120. Similarly, this type of arrangement of rollers and rods is accomplished for each belt in the second set of belts, originating from the second end 150. Rollers 250A of FIG. 2 comprise rollers 350A, 352A, and 354A of FIG. 3B. Similarly, rollers 250B of FIG. 2 comprise rollers 350B, 352B, and 354B of FIG. 3B.

Third rod 334 extends from first end rib 260 through housing 142 and terminates at a rib disposed between the first set of belts 120 and the second set of belts 130, so is also disposed between the third set of belts 160 and fourth set of belts 170. Between first end rib 260 and rib 262 a drive roller 336 is secured to third rod 334, such that rotation of the third rod causes rotation of drive roller 336. A free spinning roller 338 opposes drive roller 336 with a first belt 161, of the third set of belts 160, disposed between rollers 336 and 338. The force exerted by drive roller 336 on belt 161 is opposed by free spinning roller 338, causing sufficient traction by drive roller 336 to move belt 161. Additionally, guide rollers 354A and 354B serve to guide belt 161, with guide roller 354A guiding belt 161 at one outer edge and guide roller 354B guiding belt 161 at the other outer edge. The arrangement of rollers and rods is accomplished for each belt in the third set of belts 160. Similarly, this type of arrangement of rollers and rods is accomplished for each belt in the fourth set of belts, originating from the second end 150.

FIG. 3C shows a cross section C-C taken at line C-C of FIG. 1A, which is a view of rib 262. Rib 262 includes a set of guide openings 360A that assist in supporting guide roller rods that hold each of the guide rollers 350A, 352A, and 354A. Like rods 314 and 334, the guide roller rods extend from the first end rib 260 through housing 142 and terminates at a rib disposed between the first set of belts 120 and the second set of belts 130, so is also disposed between the third set of belts 160 and fourth set of belts 170. In other embodiments, the guide roller rods could extend through the center rib, extending from the first end 140 to the second end 150. For each belt, a set of guide rollers is provided, as is shown in FIG. 3B. Similarly, a set of guide openings 360B is provided for rods that hold each of rollers 350B, 352B, and 354B. A first driver rod support 370 supports rod 314 as it passes through rib 262 and a third drive rod support 380 supports rod 334 as it passes through rib 262.

Figure 4A:
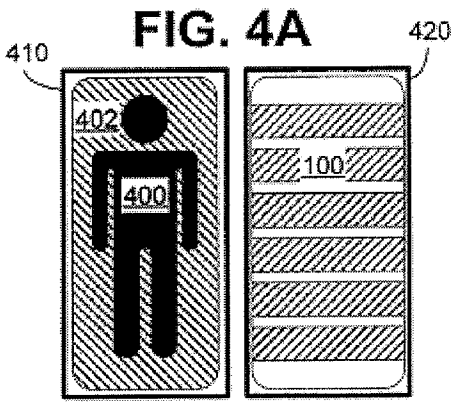
FIG. 4A through FIG. 4E are a series of figures showing transferal of a body from a first surface to a second surface using the body transfer system of FIG. 1A and FIG. 1B.
Figure 4B:
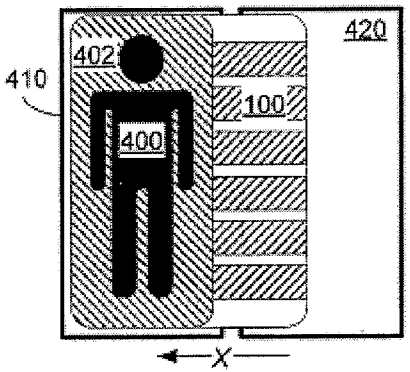

FIGS. 4A, 4B, 4C, 4D, and 4E is a series of figures illustrating the transfer of a body 400 from a first surface 410 to a second surface 420 using the body transfer system 100. As examples, in a hospital setting, either of the first and second surfaces could be a stationary bed, transfer bed, operating table, or x-ray table. In FIG. 4A body 400 is at rest on a mat 402, which is at rest on the first surface 410. The body transfer system 100 is at rest on second surface 420, and ready to move in the direction of arrow X, i.e., toward the body 400. In FIG. 4B, the body transfer system has moved itself in the direction of arrow X and has begun to burrow under mat 402 and, therefore, below body 400.

Figure 4C:
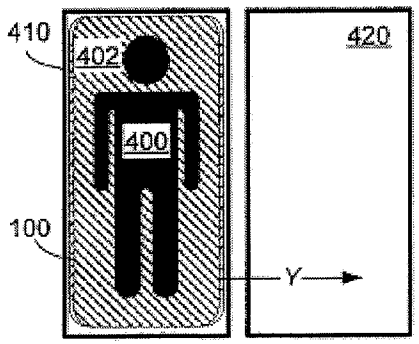
Figure 4D:
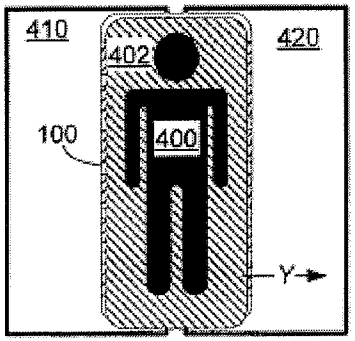
Figure 4E:
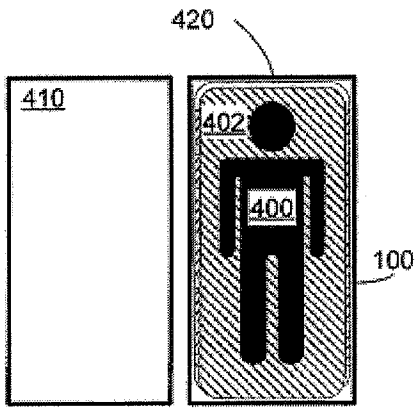

In FIG. 4C the body transfer system 100 has completely burrowed under mat 402 and body 400 and is ready to begin movement in the direction of arrow Y, which is generally opposite of arrow X from the previous figures. FIG. 4D shows the body transfer system 100 having begun the transfer of the body from the first surface 410 to the second surface 420. In doing so, the body transfer system 100 has moved in the direction of arrow Y with the mat 402 and body 400 carried thereon. FIG. 4E shows the body transfer system 100 having completed the transfer of the body 400 to the second surface 420. The body transfer system 100, could remain under the mat 402 and body 400, or it could burrow itself from underneath the mat 402 and body 400 back to the first surface 410. Of course, the body transfer system 100 could be used to transfer the body to a third surface, e.g., an operating table, x-ray table, or another bed.

Use of mat 402 is optional, but if used, mat 402 is preferably an x-ray translucent pad. Additionally, as an example, mat 402 could be a visco-elastic polymer gel pad, which could include an anti-microbial, antibacterial, latex free covering providing for better sanitary conditions, such as the Blue Diamond® polymer gel pads provided by David Scott Company of Framingham, Mass., USA. If mat 402 is not intended to remain beneath a patient in an x-ray setting, then it is not necessary that it be x-ray translucent. For use with the body transfer system 100 as described herein, the dimensions (height×width×thickness) of mat 402 are about 76"×27"×1".

Control of the body transfer system may be by one or more of a variety of means. For example, a control panel (not shown in FIG. 1A) could be included within first end 140 or second end 150 of the body transfer system 100. In other embodiments, control could, additionally or alternatively, be by a remote control mechanism. Such a remote control mechanism may be tethered to the body transfer system 100 by a communication cable or it may communicate with the body transfer system via infrared signals. Additionally, memory may be provided such that the translation distance from the second surface 420 to the first surface 410 is stored and used as a parameter by the body transfer system 100 to automatically determine a translation distance from the first surface 410 back to the second surface 420 with a body, refer to FIG. 4A through FIG. 4E. Such a feature can ensure the body transfer system does not overrun the second surface. In other embodiments, the body transfer system 100 may include detectors that sense the end of the first surface, second surface, or each and that ceases transfer in response to a detection of the end of such a surface, again to avoid overrun.

Figure 5:
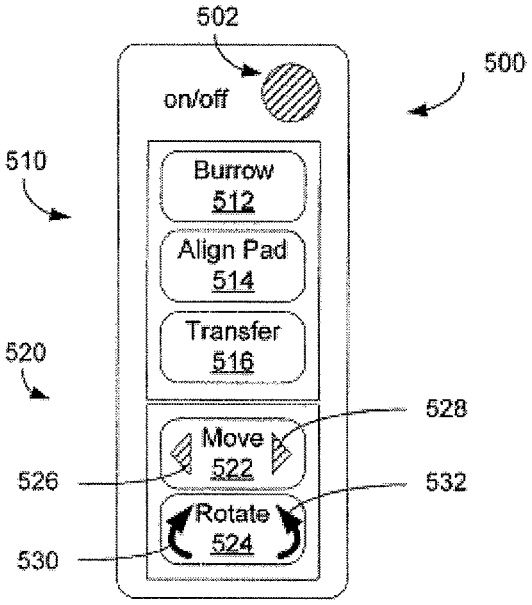
FIG. 5 is a front view of a remote control device that may be used with the body transfer system of FIG. 1A and FIG. 1B.

FIG. 5 shows a remote control 500 for use with the body transfer system 100. Remote control 500 includes an on/off (or power) button 502 that, when put in the "on" position, enables the body transfer system 100 for use. In this embodiment, there is a mode selection section 510 that includes three user selectable belt control modes, chosen with actuation of a corresponding belt mode button. The three mode buttons are: burrow 512, align 514, and transfer 516. Each mode may require use of a different combination of belts.

For example, when the burrow mode button 512 is selected, the body transfer system 100 is enabled to move (or burrow) beneath or from underneath the body 400, and mat 402, if used. In the burrow mode, the top belts 120, 130 and the bottom belts 160, 170 are actuated. When the align mode button 514 is selected, the body transfer system 100 is enabled to make relatively small adjustments in the position of the body 404 (or mat 402) relative to the body transfer system 100. In the align mode, only the top belts 120, 130 are actuated. When the transfer mode button 516 is selected, the body transfer system 100 is used to move itself with the body 400, and mat 402, if used. In the transfer mode, only the bottom belts 160, 170 are actuated.

Remote control 500 also includes a move command section 520, having a move button 522 and a rotate button 524. The move button 522 includes two actuation devices, a left move arrow 526 and right move arrow 528. Depression of the left move arrow 526 causes movement of the body transfer system 100 in the left direction, i.e., in the direction of arrow X in FIG. 1A. Similarly, depression of the right move arrow 528 causes movement of the body transfer system 100 in the opposite direction of the left arrow button, i.e., in the direction of arrow Y. Rotate button 524 also includes two actuation devices, a rotate clockwise arrow 530 and rotate counter clockwise arrow 532. Depression of the rotate clockwise arrow 530 causes rotation of the body transfer system 100 in a clockwise direction. Similarly, depression of the rotate counter clockwise arrow 532 causes rotation of the body transfer system 100 in a counter clockwise direction. Rotation of the body transfer system 100 is accomplished when the sets of belts on a surface, i.e., top surface 110 or bottom surface 190, move in different directions or, if in the same direction, at different rates of speed.

Figure 6:
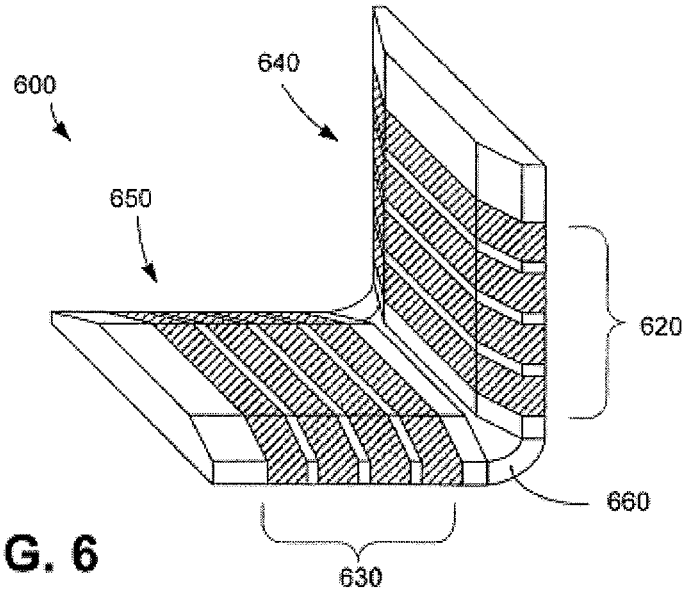
FIG. 6 is a perspective view of an alternative embodiment of a body transfer system having a hinge, in accordance with the present invention.

FIG. 6 shows a body transfer system 600 that is similar to that of FIG. 1A and FIG. 1B, but is hinged near its center. The body transfer system 600 includes a top portion 640 and a bottom portion 650 that are coupled together by a hinge system 660. The top portion 640 includes a first translation mechanism, here a set of belts 620, and the bottom portion includes a second translation mechanism, here a second set of belts 630. Like the body transfer system 100 of FIG. 1A and FIG. 1B, body transfer system 600 also includes a third set of belts (not shown) and fourth set of belts (not shown) on its bottom surface (not shown). The sets of belts are driven by motors, such as is described with respect to the body transfer system 100 of FIG. 1A and FIG. 1B.

The body transfer system 600 could include one or more locking mechanisms that lock the body transfer system in a fully open or flat position, like the body transfer system 100 of FIG. 1A and FIG. 1B. In other embodiments, the body transfer system 600 may include one or more locking mechanisms that lock the top portion 640 of the body transfer system 600 relative to a bottom portion 650 of the body transfer system 600 at any of a variety of angles. Such locking mechanisms may be included as part of the hinge system 660. The body transfer system 600 may be particularly useful when transferring a body from a first surface in a seated position to a second surface in a lying position, or vice versa. And, it may be particularly useful with chair/bed systems that convert between bed and chair positions, such as the Stretchair™ by Basic American Medical Products, Largo, Fla., USA. Additionally, the body transfer system 600 may be useful to transfer a body from a first seated position surface to a second seated position surface.

In any of the above embodiments, or in similar embodiments, or in any known patient bed or chair, a variety of pads in accordance with the present invention may be used for supporting or transferring a body. FIGS. 7A-E are illustrative embodiments of such inventive pads. Preferably, pads in accordance with the present invention are radiolucent, anti-microbial, latex free and anti-bacterial, characteristics that are generally known in the art. But the present invention is not limited to pads comprising those characteristics; the need for the pads to comprise such characteristics is largely a function of the use of the pads. Of course, as medical advances continue, other characteristics may prove advantageous in pad technology, e.g., in materials or treatment of materials used in making such pads. The present invention anticipates incorporation of such advances. In the context of the body transfer system described herein, such pads are configured to be useful in the transfer of, for example, patients being transferred between surfaces or beds using the body transfer system. As such, the pads facilitate (or at least to not hinder) the relative movement of the body and the transfer device described above.

Figure 7A:
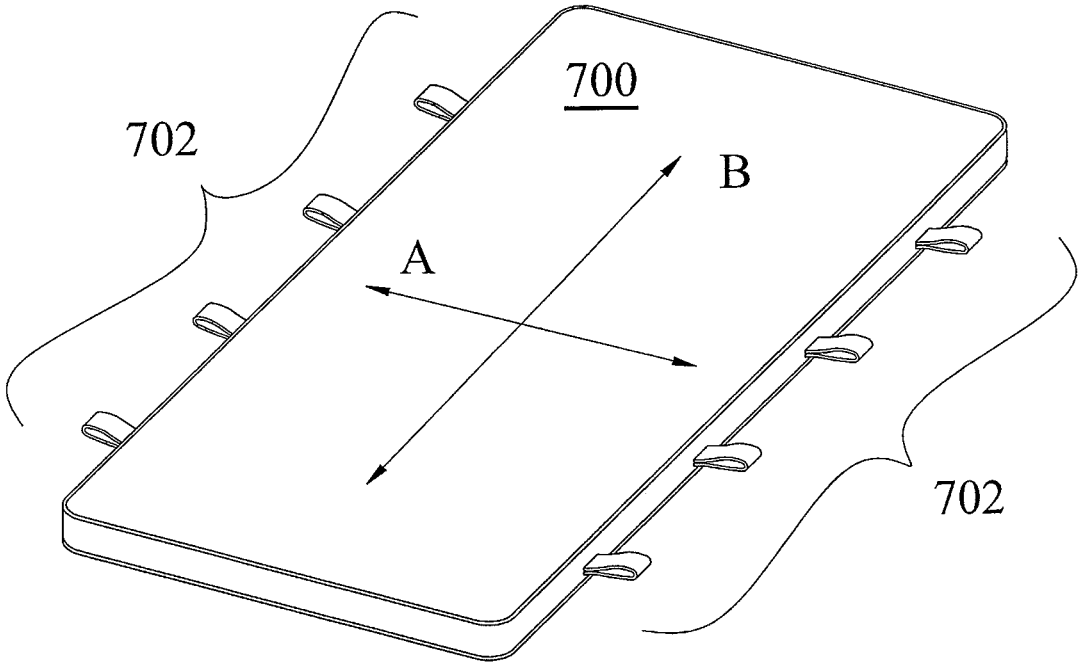
FIGS. 7A-F are perspective views of various pads that could be used for supporting or transferring a body, e.g., with the body transfer system.

FIG. 7A shows a first embodiment of a pad 700 in accordance with the present invention. In the embodiment of FIG. 7A, pad 700 is a pad for a patient bed, so is generally rectangular. Pad 700 includes several draw-straps 702 disposed about its periphery. In FIG. 7A the draw-straps are shown along the longer edges (or sides) of the pad 700, and not at the bottom (i.e., foot) edge or top (i.e., head) edge of pad 700. The reason for this configuration is that such pads are typically moved in the laterally (in the direction of arrow A), as is shown in FIGS. 4A-E. Therefore, draw-straps in the head and foot ends of pad 700 would typically not be considered useful in such translations. However, if movement in the opposite direction (in the direction of arrow B) is desired or if draw-straps on the head and foot ends of pad 700 were useful in translation in the direction of arrow A, then such straps could be included. In FIG. 7A, the draw-straps could be useful in a physical sliding of the pad (e.g., with a patient disposed thereon) from a first surface to a second surface. In other embodiments, the body transfer system could be configured to engage the draw-straps 702 for assisting in the translation of the pad 700 (e.g., with patient) on and/or off of the body transfer system. In other embodiments, the draw-straps could be used to engage with a pulling system configured for pulling the pad (e.g., and patient) from a first surface to a second surface, and vice versa.

In the above embodiment, a translation or pulling system could be coupled to or disposed proximate to the edge of the patient bed, transfer bed or stretcher for engaging the draw-straps and pulling the pad (with patient) from the first surface to the second surface, by for example electro-mechanical or mechanical means.

Figure 7B:
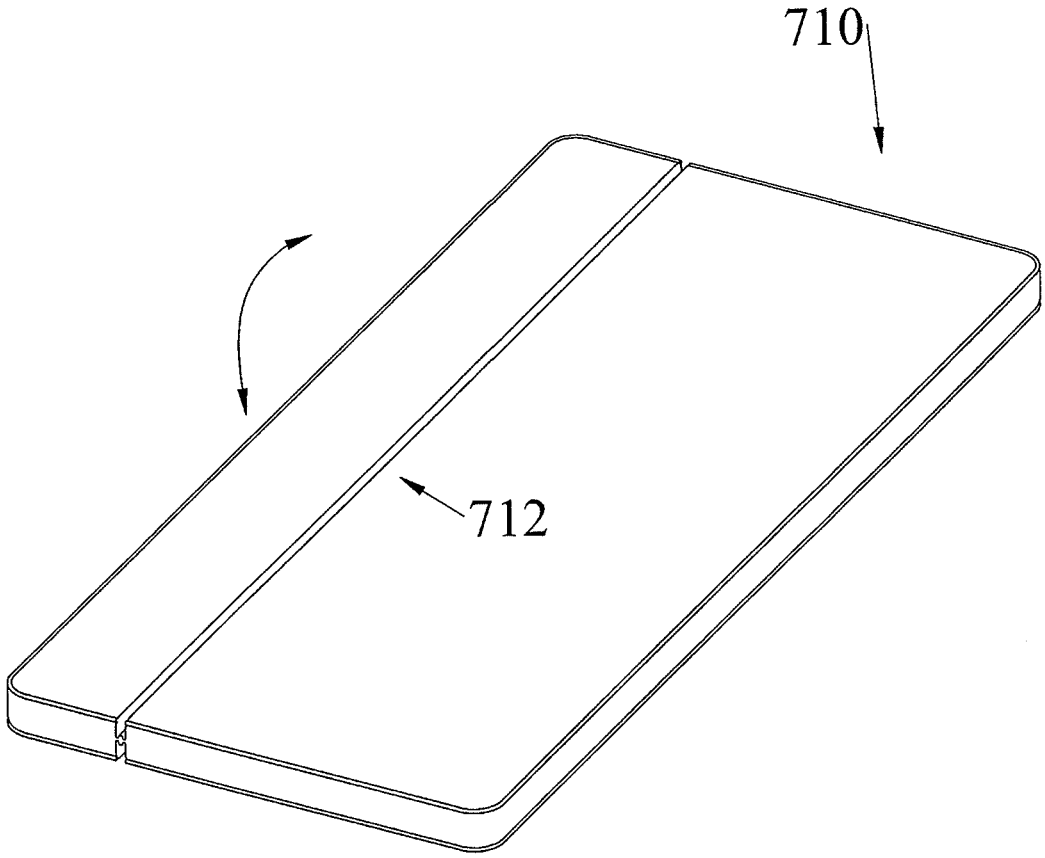

In the embodiment of FIG. 7B, a pad 710 is configured with a "living hinge" 712, which acts as a built-in hinge in pad 702 to allows hinge-like bending of the pad along the living hinge 712. The living hinge 712 allows the pad 710 to conform to narrow beds or stretchers, while also accommodating standard size beds. For instance, the width of a typical hospital bed is greater, typically, than the width of a transfer bed or stretcher used for moving a patient. As a result, in practice, e.g., using the body transfer system, the pad 710 may stay with the patient regardless of whether in a typical hospital bed or on a transfer bed or stretcher, and as the patient transfers from one to the other during its hospital stay—because the living hinge 712 accommodates both and the pad is preferably formed to have a comfort level commensurate with that of typical patient bed mattresses, as a minimum. As a result, there is less disruption of the patient when transferring the patient between surfaces, because the patient remains on the pad 710.

Figure 7C:
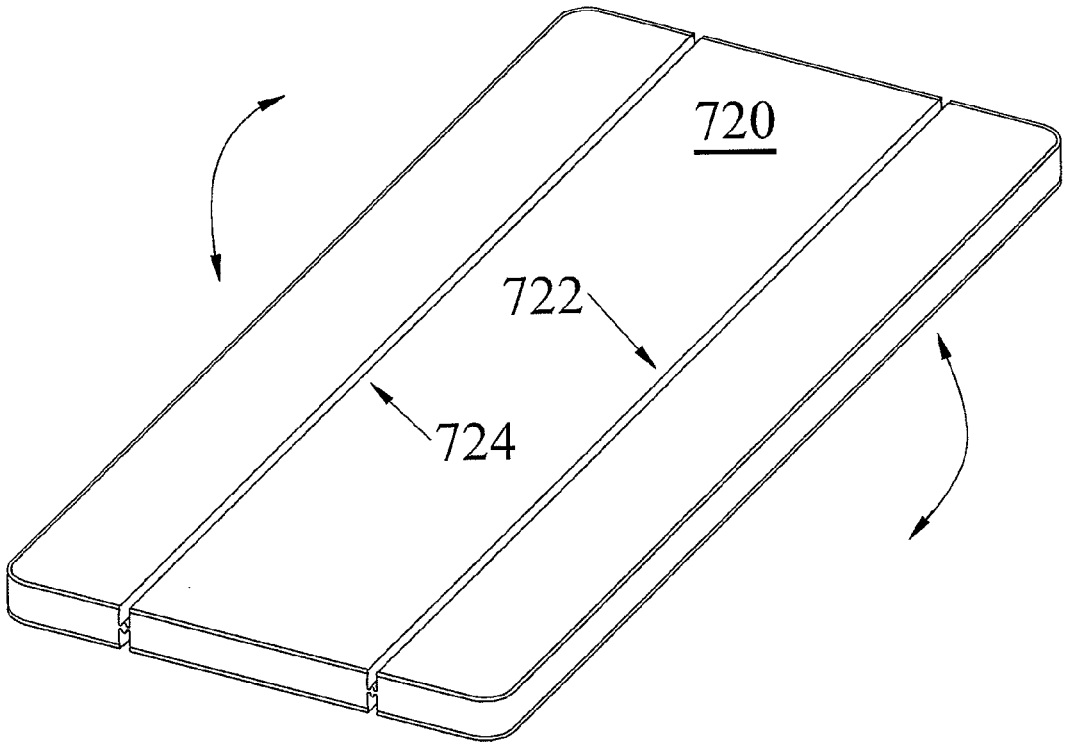

In the embodiment of FIG. 7C, a pad 720 is formed with two living hinges, 722 and 724. Again, such a pad accommodates a variety of bed widths. The built-in living hinges 722 and 724 allow the pad to conform to a typical patient bed, transfer bed or stretcher.

Figure 7D:
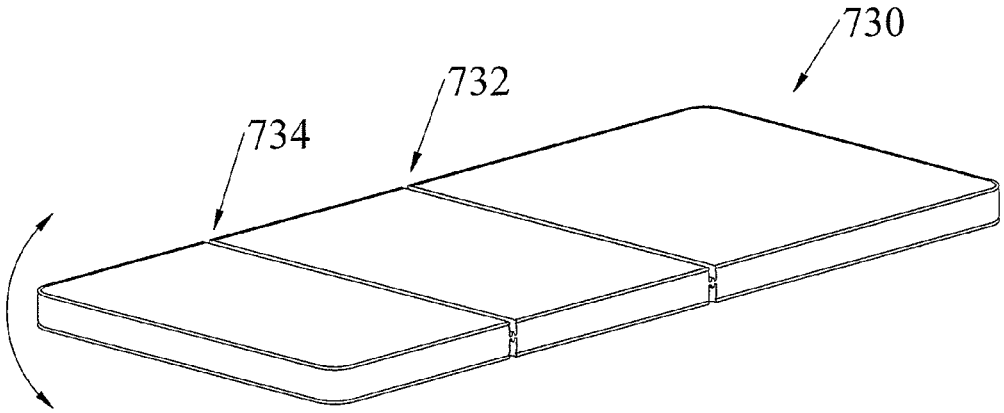

In the embodiment of FIG. 7D, a pad 730 is formed having 2 living hinges 732 and 734. Like the embodiment of FIG. 7C, pad 730 can accommodate a variety of devices for supporting or moving a patient. These living hinges 732 and 734 are laterally disposed, as opposed to the longitudinally disposed living hinges in the pad 720 of FIG. 7C. As such, the hinges 732 and 734 allow the pad 730, while useful in a typical patient bed, is also able to conform to patient chairs and beds that fold up into seated position.

Figure 7E:
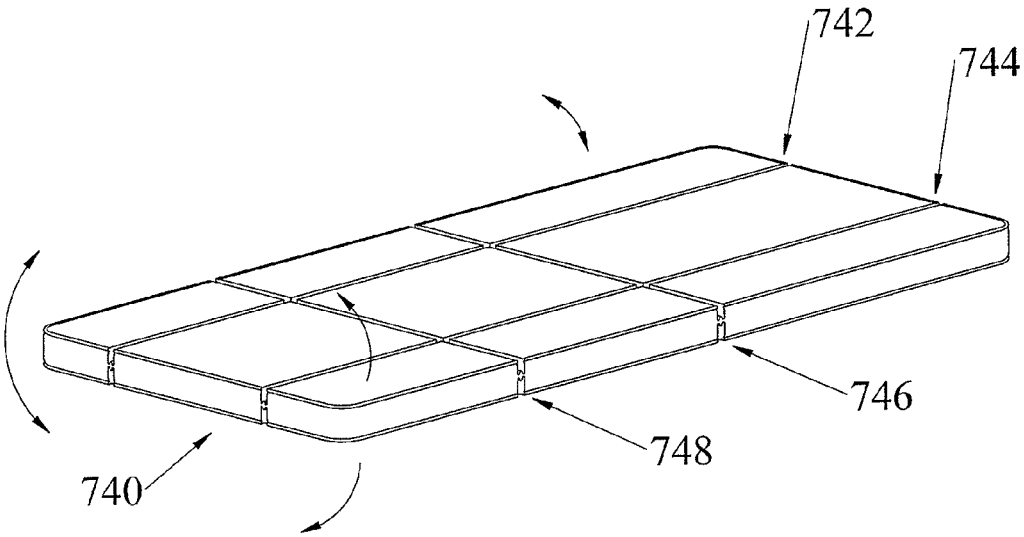

In the embodiment of FIG. 7E, a pad 740 is formed having four living hinges 742, 744, 746 and 748. Living hinges 742 and 744 are longitudinally disposed, such as living hinges 722 and 724 of FIG. 7C. Living hinges 746 and 748 are laterally disposed, such as living hinges 732 and 734 of FIG. 7D.

Figure 7F:
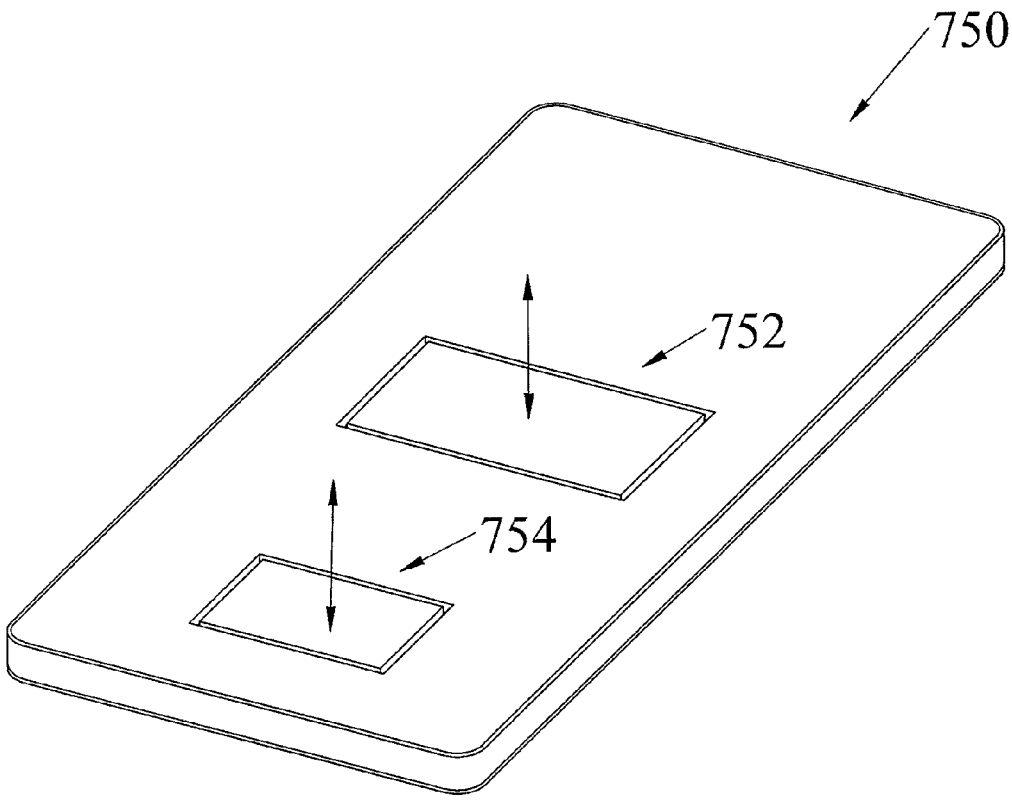

In FIG. 7F, a pad 750 is formed having removable pads. In this embodiment, there are two removable pads provided merely as examples, pad 752 and 754. Pad 752 is a removable pad that may removable to allow insertion of a bed pan or similar apparatus, which makes provides greater comfort for the patient. Or in other circumstances, removal of the pad could allow the patient to be transferred to a commode while remaining on the pad, and allowing the patient use the commode while on the pad. Similarly, foot pad 754 may be removable to facilitate greater movement or ease of manipulation of the feet of a patient disposed on the pad 750. Of course, other types of removable pads could be comprised within pad 750. Also, rather than, or in addition to, being removable pads 752 and 754 may be inflatable and deflatable to, for example, effect a desired firmness of height of the respective pads. Fully deflating a removable pad could offer the same benefits as removing the pad discussed above.

In any of the embodiments described herein, or other embodiments, such pads could include draw-straps, such as the draw-straps 702 of FIG. 7A. Also, in any of the embodiments, such mattresses could be mattresses selectively filled with air or some other fluid. The pads could have difference zones to achieve different firmness in different regions of the pad. In any of the foregoing, the pad preferably accommodates movement of a body using the body transfer system discussed above. The pads could also be made of gel or memory foam, as example, or any combination of the foregoing. Additionally, any of the of the pads could have a mechanism for securing or maintaining the pads to the bed, such "fitted corners" or Velcro means for providing such function. In any of the embodiments, the pad could be disposed on top of a traditional mattress or used in place of the mattress altogether.

In various embodiments, the pads could be multilayered, i.e., include at least portions comprising a plurality of material layers.

Figure 8:
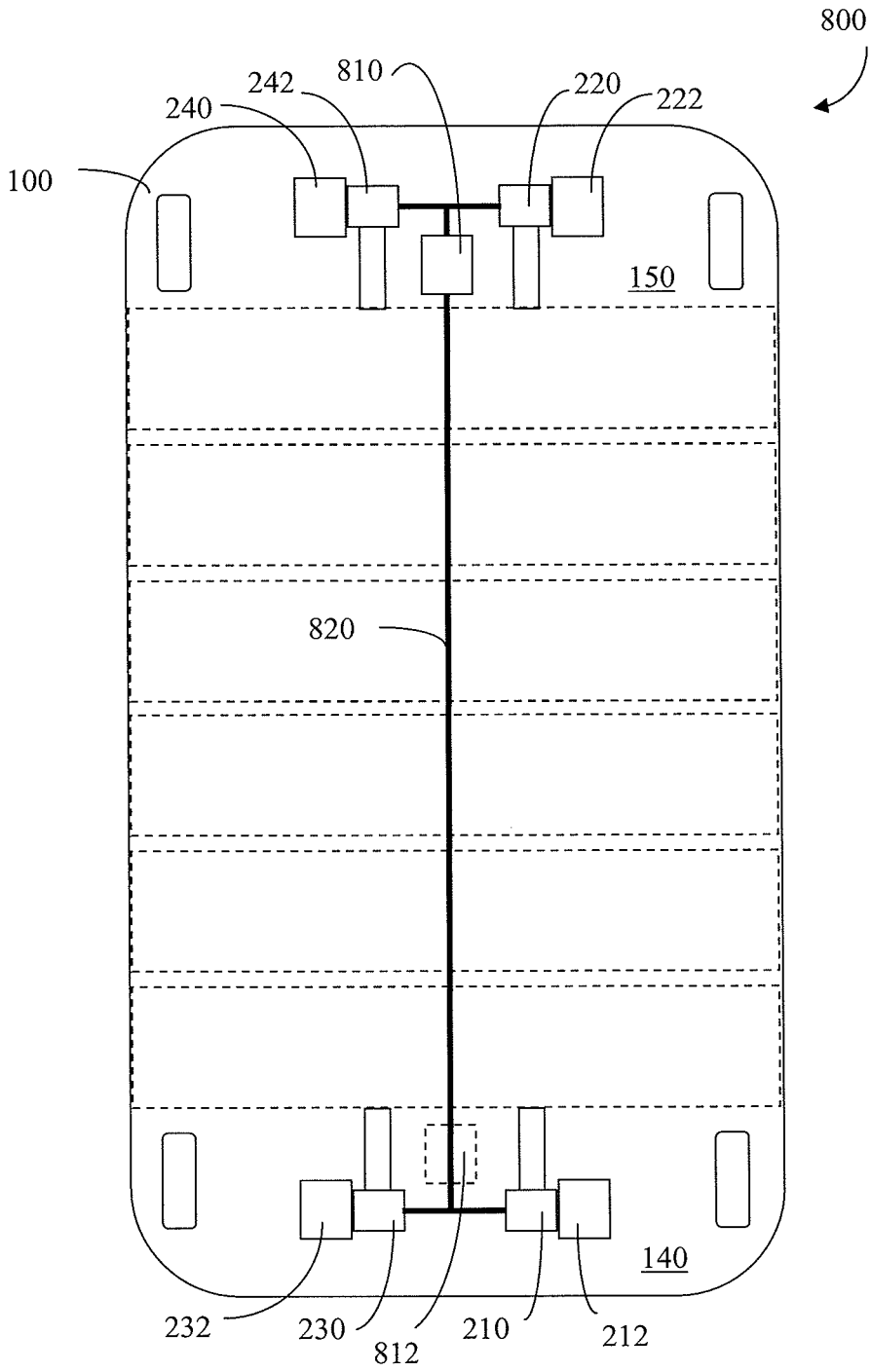
FIG. 8 provides an embodiment of a motion control system that can be implemented with a body transfer system, such as that described herein or in other types of body transfer systems, in accordance with aspects of the present invention.

FIG. 8 provides an embodiment of a motion control system 800 that can be implemented with a body transfer system, such as that described herein or in other types of body transfer systems.

In a first embodiment, the motion control system 800 is a yaw control system 800 that senses and adjusts for angular deviation in the direction of motion of a patient transfer device.

In a first embodiment, the patient transfer device can include a yaw control (or closed loop) system 800 to promote and/or insure straightness of travel. That is yaw control system 800 can sense and adjust for angular deviation in the direction of motion of the patient transfer device. Therefore, yaw control system 800 is preferably a closed-loop system, i.e., a system using a feedback loop (or bus) 820.

Referring to FIG. 8, yaw control system 800 can include one or more yaw sensors 810, 812 in communication with the bottom translation mechanisms, and possibly with the top translation mechanisms, of the patient transfer device. Using the patent transfer device 100 above as an example, variations in friction in the pinch and drive rollers or other translation or drive mechanisms and/or slippage between the belts and bedding surfaces may lead the transfer device 100 to traverse the bedding and other hospital surfaces in a non-straight manner. This then requires the use of the turning mode discussed above more often than desired. When the patient transfer device is operated to move in a forward or reverse direction, a straight path is desired. If an obstacle or variation in slippage is encountered, the device 100 may not progress in the desired straight path. The addition of the yaw control system 800 solves this problem.

Here, as examples, one or more accelerometers or gyroscope sensors (as yaw sensors) 810 (and optionally 812) can be mounted within, or integral with, the housing. The yaw sensor or sensors 810, 812 sense the yaw rotation of the transfer device 100 and increase or decrease the motor speed of the opposite end motors to adjust belt speeds of the bottom belts to achieve a straight path of operation. In FIG. 8, the yaw sensors 810, 812 are mounted in the first end 140 and/or second end 150 of the patient transfer device 100, for example, and coupled to appropriate ones of the motor controllers 212, 222, 232, and 242, according to which motors 210, 220, 230, and 240 are to be engaged in yaw control. For example, gyro 810 could be mounted on a printed circuit board in the housing. The gyro will sense unit rotation and make current adjustments to the motors, thereby controlling and compensating for yaw. However, the present invention is not limited to such placement of the one or more yaw sensors 810, 812.

The motion control system 800 could be limited to just control of the lower belts, as a yaw control system, as described above. In other embodiments, the motion control system could be implemented to additionally or alternatively control the top translation mechanisms, e.g., to adjust for non-straight orientation of a patient loaded or being loaded on a patient transfer.

If the motion control system 800 were implemented as a patient orientation system, in one embodiment it could sense and adjust of patient rotation or misalignment (or askew) using one or more sensors 810, 812. For example, sensing misalignment could be done without a gyro, i.e., using magnets, bar codes, or other position sensors at both ends to ensure that the patient did not rotate. In such embodiments, the one or more sensors could control the top translation mechanisms (e.g., 2 sets of top belts) by adjusting the current to their respective motors.

While the foregoing has described what are considered to be the best mode and/or other preferred embodiments, it is understood that various modifications may be made therein and that the invention or inventions may be implemented in various forms and embodiments, and that they may be applied in numerous applications, only some of which have been described herein. As used herein, the terms "includes" and "including" mean without limitation. It is intended by the following claims to claim any and all modifications and variations that fall within the true scope of the inventive concepts.

What is claimed is:

1. A system for transferring a body from a first surface to a second surface, comprising:

a frame configured to support a body;

a bottom translation mechanism disposed at the bottom portion of the frame and configured to engage the first surface and the second surface and to translate the system back and forth between the second surface and the first surface, the bottom translation mechanism comprising at least two belts independently controlled by at least two respective internal drive motors;

a top translation mechanism disposed at the top portion of the frame and configured to burrow the system between the first surface and the body as the bottom translation mechanism transfers the system from the second surface to the first surface; and a yaw control system within the frame and comprising at least one yaw sensor operatively coupled to the at least two drive motors of the bottom translation mechanism to form a closed-loop feedback system configured to continuously sense non-straight motion of the frame and responsively and independently adjust the speed of the at least two drive motors to achieve a straight path as the system for transferring a body moves between the first and second surfaces.

2. The system of claim 1, wherein the frame is a housing having a substantially planar top portion configured to support a body and having a substantially planar bottom portion.

3. The system of claim 1, wherein the yaw control system comprises:

at least one sensor; and a feedback loop shared between the at least one sensor and the bottom translation mechanism.

4. The system of claim 3, wherein the at least one sensor includes at least one accelerometer.

5. The system of claim 3, wherein the at least one sensor includes at least one gyroscope sensor.

6. The system of claim 1, wherein the at least two independently controlled translation mechanisms of the bottom translation mechanism comprises at least two sets of independently controlled belts.

7. The system of claim 1, wherein each of the at least two independently controlled translation mechanisms that are each operatively coupled to the yaw control system includes at least one motor having an output adjusted in response to the yaw control system.

8. A system for transferring a body from a first surface to a second surface, comprising:

a frame configured to support a body;

a bottom translation mechanism disposed at the bottom portion of the frame and configured to engage the first surface and the second surface and to translate the system back and forth between the second surface and the first surface, the bottom translation mechanism comprising at least two belts independently controlled by at least two respective internal drive motors;

a top translation mechanism disposed at the top portion of the frame and configured to burrow the system between the first surface and the body as the bottom translation mechanism transfers the system from the second surface to the first surface; and a motion control system within the frame and:

comprising at least one sensor operatively coupled to the at least two drive motors of the bottom translation mechanism to form a closed-loop feedback system configured to continuously sense non-straight motion of the frame and responsively and independently adjust the speed of the at least two drive motors to achieve a straight path as the system moves between the first and second surfaces, and the at least one sensor also operatively coupled to the top translation mechanism as part of the closed-loop feedback system, which is also configured to sense and adjust for non-straight alignment of a body loaded or loading onto the frame.

9. The system of claim 8, wherein the motion control system includes a yaw control system operatively configured to control the bottom translation mechanism.

10. The system of claim 9, wherein the motion control system includes a patient orientation system operatively configured to control the top translation mechanism.

11. The system of claim 10, wherein:

the top translation mechanism comprises at least two independently controlled translation mechanisms that are each operatively coupled to the patient orientation system.

* * * * *